United States Patent [19]

Cosyns et al.

[11] Patent Number: 4,632,678

[45] Date of Patent: Dec. 30, 1986

[54] AIR REGENERATOR USING AN OXYGEN JET VENTURI

[75] Inventors: Max Cosyns, Brussels, Belgium; Ruben Gomez, 64560 Licq-Atherey, France

[73] Assignees: Charles Baumert, Lucq de Bearn; Ruben Gomez, Licq-Atherey, both of France

[21] Appl. No.: 797,591

[22] Filed: Nov. 13, 1985

[30] Foreign Application Priority Data

Nov. 13, 1984 [FR] France ..... 84 17308

[51] Int. Cl.[4] ..... B01D 53/04

[52] U.S. Cl. ..... 55/180; 55/58; 55/189; 422/223; 502/38

[58] Field of Search ..... 55/58, 159, 180, 189, 55/387; 422/122, 123, 223; 502/38, 52

[56] References Cited

U.S. PATENT DOCUMENTS 3,696,588 11/1972 Dussourd et al. ..... 55/189 X
3,834,136 9/1974 Dussourd et al. ..... 55/189 X
3,934,989 5/1976 Haugen ..... 55/189 X
4,542,114 9/1985 Hegaorty ..... 502/38 X

*Primary Examiner*—Charles Hart
*Attorney, Agent, or Firm*—Oblon, Fisher, Spivak, McClelland, & Maier

[57] ABSTRACT

An air regenerator is provided comprising, in a cylindrical duct 4 communicating laterally with filtering cartridges 5, a venturi 1 whose outlet horn 1*a* is connected to a regenerated air outlet tube 3.

The end of the inlet horn 1*a* is open and emerges inside duct 4. At a given distance with respect to horn 1*b* emerges a nozzle 2 whose mouthpiece is bored with a calibrated orifice of a diameter between 0.15 and 0.25 mm and whose thickness at the position of the bore is at most equal to the diameter of the orifice.

The regenerator having such a nozzle connected to a pressurized oxygen cylinder is capable of sucking large amounts of air so that the voluminal yield expressed by the ratio of the volume of regenerated air to the volume of injected oxygen easily exceeds 37.

6 Claims, 5 Drawing Figures

AIR REGENERATOR USING AN OXYGEN JET VENTURI

Figure 1:
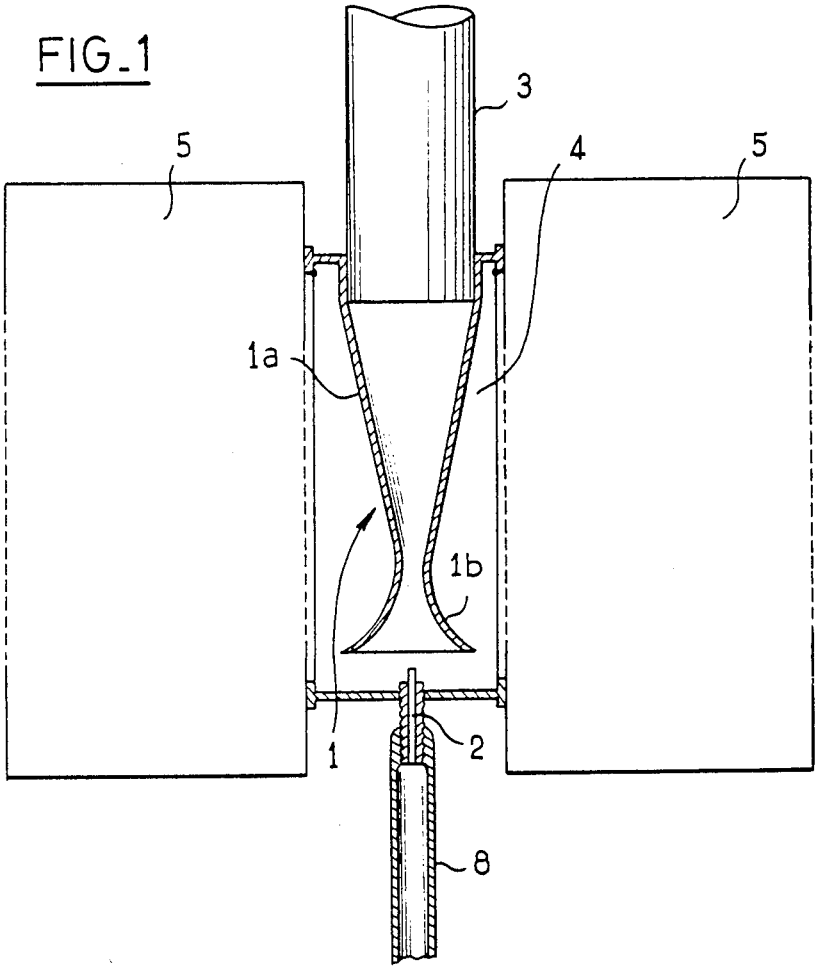

The present invention relates to air regenerators, individual or for collective premises, absorbing the carbon dioxide under the effect of a venturi drawing air through the cartridge by means of a nozzle placed in the axis of the venturi and connected to a pressurized oxygen supply.

When it is a question of supplying a closed enclosure with regenerated air, such as premises or living spaces, the amount of air regenerated must correspond to a minimum providing for the personnel present a breathable amount of air allowing a certain expenditure of energy, for example for carrying out certain work in the closed space. It is admitted that such an activity, for example of the order of 100 watt, requires a minimum supply of 37 liters of regenerated air per minute and per person.

Breathing apparatus of the above mentioned kind, operating without any addition of energy for drawing used air through the absorbant cartridge other than that of the expansion energy of oxygen compressed and injected into the venturi, consume 1 liter of oxygen at atmospheric pressure, which leads to a minimum voluminal yield:

$$Q_2/Q_1=37$$

$Q_2$ and $Q_1$ being respectively the amount of regenerated air and the amount of injected oxygen in liters.

To obtain such a voluminal yield, up to now two injectors have been used in series, operating with oxygen expanded by means of a two stage pressure reducer. Such a reducer is expensive and delicate in operation. Furthermore, the installation is cumbersome, for it also requires two venturi placed in series. Finally, the voluminal yield drops rapidly before the cylinder is exhausted, when the pressure in the cylinder reaches that of the upper pressure reducer, which reduces the volume of useful oxygen by about 10%.

The present invention is based on the discovery of the extraordinarily high potential, for driving air by means of venturi, which an oxygen jet possesses whose molecules are reorientated and whose velocity distribution becomes anisotropic and does not follow the Maxwell distribution function.

It should be recalled that the molecules forming a gas in equilibrium are propelled at all times by disordered movements which form what is called thermal agitation.

To describe the microscopic state of a gas, we must be satisfied with statistic expressions which are called the velocity distribution functions and which are basic magnitudes of the kinetic theory of gases. The movement of the molecule is characterized by a vector of its position in space r and the vector of its velocity w.

$$dr=dx\,dy\,dz$$

and $$dw=dw_x\,dw_y\,dw_z$$

the function f (rwt) being the simple velocity distribution function. A velocity distribution function is anisotropic if it only depends on the modulus of w and not on its orientation.

In the conventional calculation of injectors, the gas is considered as a perfect gas, that is to say a gas whose molecules have an isotropic distribution in direction and a Maxwellian distribution of the velocities. These conditions are approximately fulfilled when the duct of the nozzle is cylindrical, of a long length with respect to its diameter. The pressure drop in the duct is then great with respect to that at the outlet end or mouth piece and the expansion energy is mainly used for heating the oxygen cooled by its expansion.

On the other hand, if the expansion takes place through a thin wall orifice, all the expansion energy is used for reorientating the molecules whose velocity distribution becomes anisotropic. This is the case of unstationary (the distribution depends on t), inhomogeneous (the distribution depends on r) and anisotropic (distribution depends on w and on r) distribution.

The notion of temperature disappears and is replaced by a tensorial field of kinetic temperatures. This kinetic temperature in the axis of the jet may descend to less than a degree from absolute zero. Similarly, the discontinuity of the functions, when going over to supersonic speeds, disappears, the speed of sound itself becoming a function of the orientation with respect to the axis of the jet.

For such orientated molecules, the voluminal yield easily exceeds the yield of 37, which provides a minimum volume of regenerated air for the personnel working in a closed enclosure. This increased potential for driving large amounts of air through the venturi may be explained by the fact that, in an orientated molecule jet there are few lateral collisions between the oxygen molecules and that all the energy dissipated in lateral collisions will be dissipated in collisions with the driven air, thus giving a good voluminal yield of the venturi.

The air regenerator with a cartridge absorbing the carbon dioxide comprising a venturi providing suction of air through the cartridge by means of a nozzle emerging axially upstream of the constricted section of the venturi and connected to a pressurized oxygen supply in accordance with the invention is characterized in that the mouthpiece of the nozzle is formed by a relatively thin wall in which is bored a calibrated orifice and whose thickness at a position of the bore is at most equal to the diameter of the orifice, so that at the outlet of the nozzle the molecules of the oxygen jet are reorientated and the distribution of their velocities becomes anisotropic different from the distribution according to Maxwell's function.

An oxygen jet with reorientated molecules may be formed using a nozzle constituted by a relatively wide tube, for example 2 mm in diameter, and ending in a mouthpiece formed by a calibrated orifice with a net contour of a diameter of 0.15 to 0.25 mm bored in a relatively thin wall, for example of a thickness of 0.01 mm. Such an orifice pierced wall may be formed in a copper or aluminium metal foil which is pierced with the aid of an appropriate tool.

Another way of forming the mouthpiece consists in crimping, at the end of the tube, a clock pivot bearing made from ruby, saphire or cupro-beryllium whose flat face is turned outwardly and which is pierced with a central orifice whose diameter varies between 0.15 and 0.25 mm.

The venturi used may have various forms. They may be symmetrical with inlet and outlet horns of the same length or asymmetrical, the outlet horn being longer than the inlet horn. The oxygen supply pressure does not consititute a critical element, very acceptable voluminal yields being obtained in the pressure range from 0.5 to 2 bars.

Tests have shown that there exists a critical relationship between the diameter of the constricted section of the venturi and the distance at which the mouthpiece of the nozzle is placed upstream of the constricted section of the venturi, for a given oxygen pressure. Preferably, this distance is such that the diameter of the section of the oxygen jet, measured in free air, at the position of the constricted section of the venturi is substantially equal to the diameter of this section.

For checking the shape of the jet and in particular for measuring its diameter at a given distance, the jet is directed perpendicularly against a target formed by a surface of water covering a white screen immersed under a few centimeters of water. The depression of the surface under the oxygen jet is observed and its diameter is measured, when a light beam is sent parallel to the screen through the liquid. The depression creates a circle of shadow on the screen whose diameter varies with the flow rate of the nozzle and the distance therefrom to the water surface.

With this system of testing, the distance of the mouth piece of the nozzle from the constricted section may be determined as a function of the pressure of the oxygen flow so that the diameter of the section of the jet thus measured in the free air is substantially equal at the position of the constricted section of the venturi to the diameter of the section.

Figure 2:
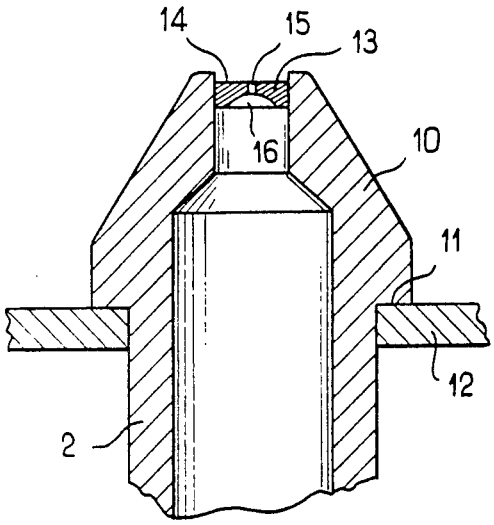
Figure 3:
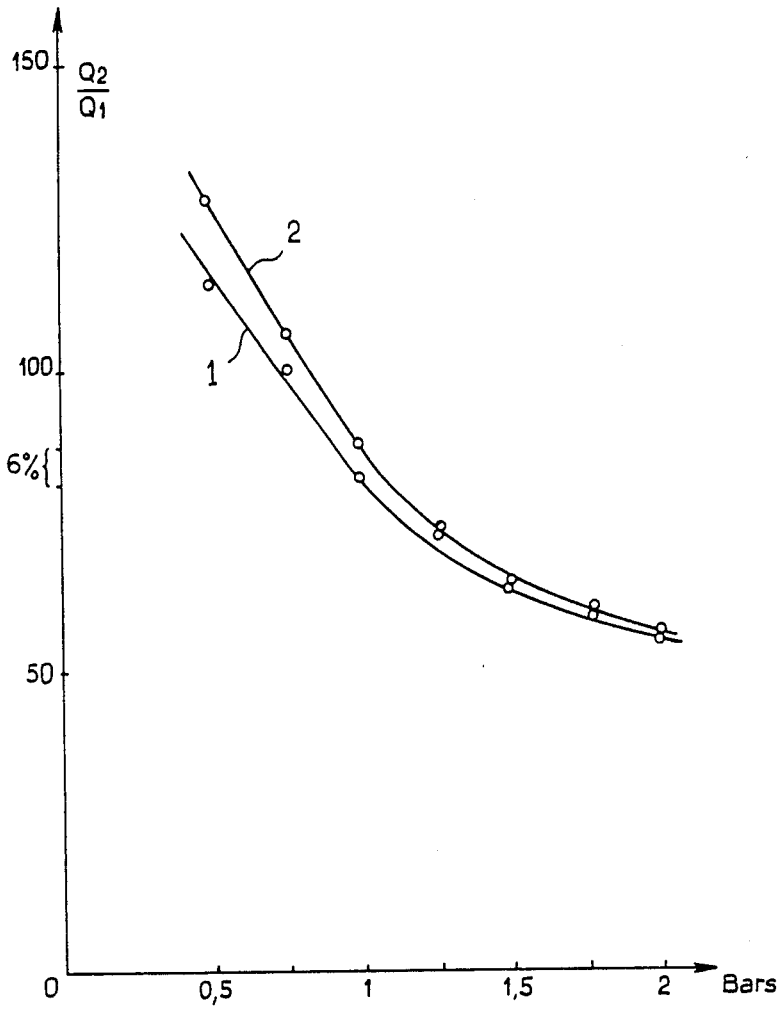
Figure 4:
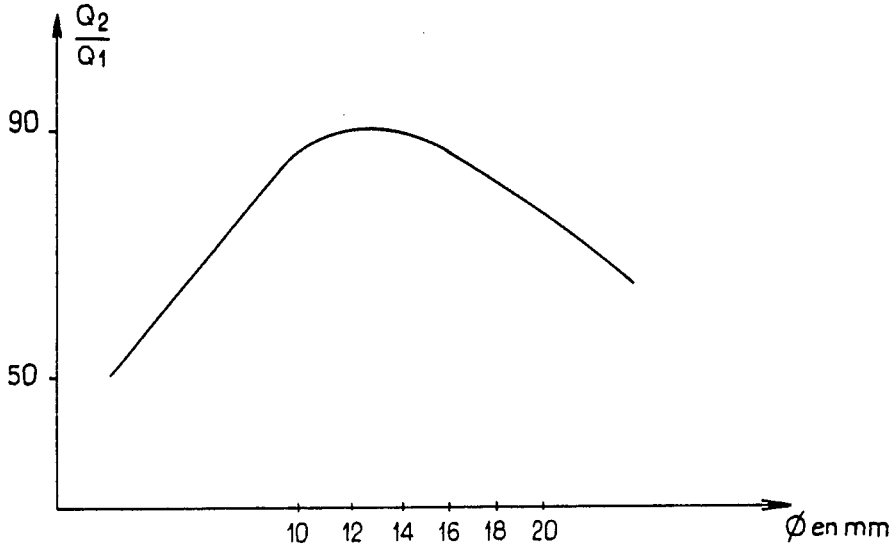
Figure 5:
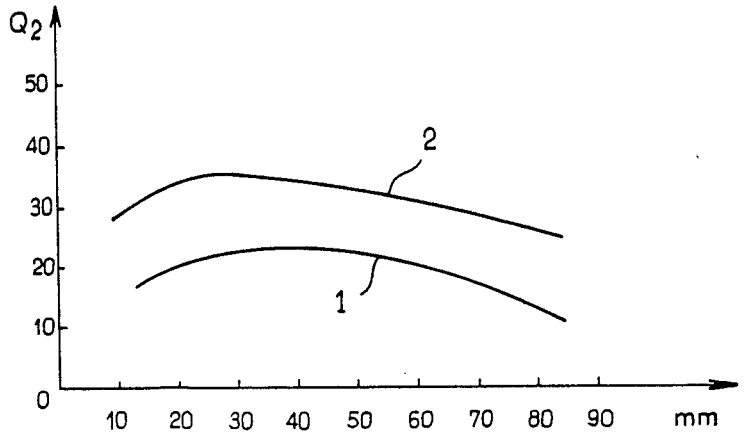

Other features of the invention will be clear from the measurements of different parameters and from one embodiment of an individual regenerator in accordance with the invention given by way of example, illustrated by the graphs and drawings, in which FIG. 1 shows an axial section of a regenerator according to the invention, FIG. 2 shows a mouthpiece in axial section formed from a clock maker's ruby, FIG. 3 is a graph giving the variations of the voluminal yield $Q_2/Q_1$ as a function of the oxygen pressure, FIG. 4 is a graph showing the variations of the voluminal yield as a function of the diameter of the constricted section of a venturi, and FIG. 5 is a graph showing the variation of the regenerated air flow $Q_2$ as a function of the distance of the mouthpiece of the nozzle from the constricted section of the venturi of a given diameter.

The air regenerator shown comprises a cylindrical duct 4 closed at the bottom, in which is placed a venturi 1 whose outlet horn 1*a* is welded to duct 4 and is connected to a regenerated air output tube 3. The opposite wall of duct 4 is in the form of a disc pierced with a central opening for passing therethrough a nozzle 2 connected through a duct 8 to the pressure reducer of a compressed oxygen cylinder. The end of the inlet horn 1*b* is open and opens freely inside the cylindrical duct 4. This duct communicates with two filtering cartridges 5 for absorbing the carbon dioxide, disposed on each side of the cylindrical duct 4. The cartridges 5 are removably fixed by application under pressure against the plastic material seal. Nozzle 2 has a mouthpiece shown in FIG. 2. An end piece 10, having a circular shoulder 11 intended to bear against a support 12, ends in a constricted section at the end of which is crimped a ruby 13. This clockmaker's ruby is cut so as to have a flat face 14 in which opens a calibrated orifice 15 of a diameter of 0.20 mm. The inner face of the ruby is cut so as to have a hollow 16, which reduces its thickness at the position of the bore to 0.20 mm. The venturi used is asymetrical in shape. Its inlet horn, of a very bell mouthed shape, measures 20 mm, while its outlet horn of a conical shape of a length of 60 mm ends in a widened portion 30 mm in diameter. The diameter of the constricted section of the venturi is 12 mm.

The inner diameter of the nozzle at the position of the narrowing of the section is 2 mm. The thickness of the ruby at the position of the bore is 0.2 mm. The expansion of oxygen at the narrowed portion of the venturi causes upstream a depression which results in drawing the polluted air through the cartridges, causes it to pass inside the venturi where it is mixed with oxygen and causes a mixture of purified air and pure oxygen to leave through tube 3.

By varying the oxygen pressure between 0.5 and 2 bars, its influence on the voluminal yield $Q_2/Q_1$ has been shown in FIG. 3 for two venturi of different forms, having the same diameter of the narrowed portion. It can be seen that the voluminal yields remain substantially above the standard which has been fixed, namely 37 liters of regnerated air per liter of oxygen injected. The yields for a pressure of 1 bar differ between a venturi with a symmetrical shape (curve 1) and a venturi with an asymmetric shape (curve 2) and vary by only 6%, which proves that the shape of the venturi does not constitute an important criterion of choice.

According to tests, the pressure loss caused by fitting an abscrbant cartridge lowers the voluminal yield by 10%, the end piece intended for the other cartridge being closed. The yield only drops by 5% when two cartridges are mounted.

From tests, the results of which are shown in the graph of FIG. 4, the variation of the voluminal yield with the variation of the diameter of the constricted section of the venturi may be determined for a venturi of given shape (outlet diameter of 30 mm) and for a given oxygen pressure (1 bar). It will be noted that the yield is of the order of 90 for a diameter of the section between 10 and 15 mm, when the measurements are effected with optimum distances between the mouthpiece of the nozzle and the constricted section of the venturi for each diameter.

The results of measurements made concerning the distance between the mouthpiece of the nozzle and the constricted section of the venturi are shown in FIG. 5. The two curves 1 and 2 show the variation in the flow of regenerated air $Q_2$ with the distance of the mouthpiece from the constricted section of the venturi for a venturi whose constricted section has a diameter of 12 mm and for oxygen flows of 1 bar (curve 1) and 2 bars (curve 2). In the case considered, the optimum flow is between 20 and 40 mm of distance. These distances correspond to forms of jets such that the diameter of their section, measured in the free air, is substantially equal at the position of the constricted section to the diameter thereof.

Similar curves may be plotted for each diameter and each pressure. Generally it is found that for an oxygen pressure varying from 1 to 2 bars, and with the mouthpiece of the nozzle situated at a distance of 20 to 40 mm upstream of the constricted section of the venturi whose diameter varies between 8 and 12 mm, the voluminal yields obtained were optimum of the order of 90.

The device of the invention forms an undeniable progress in the field of regenerated air supply in a closed enclosure, for it allows an increased supply to be obtained and largely sufficient for the breathing comfort of persons who are present therein by means of a compact apparatus and without any external energy supply other than that provided by the expansion of the compressed air from a cylinder.

The invention is not limited to the embodiments described but extends to all the variants which may occur to a man skilled in the art.

We claim:

1. An air regenerator having a cartridge (5) absorbing the carbon dioxide comprising a venturi (1) ensuring the suction of air through the cartridge by means of a nozzle (2) emerging axially upstream of the constricted section of the venturi and connected to a pressurized oxygen supply, characterized in that the mouthpiece of the nozzle is formed by a relatively thin wall (13) in which is bored a calibrated orifice (15) and whose thickness at the position of the bore is at most equal to the diameter of the orifice, so that at the outlet of the nozzle the molecules of the oxygen jet are reorientated and the distribution of the velocities becomes anisotropic, different from the distribution according to Maxwell's function.

2. The regenerator according to claim 1, characterized in that the distance at which the mouthpiece of the nozzle (2) is situated with respect to the constricted section of the venturi is such that the diameter of the section of the oxygen jet, measured in free air, at the position of the constricted section of the venturi is substantially equal to the diameter of this section.

3. The regenerator according to claim 1, characterized in that the nozzle (2) is formed by a tube having a relatively large inner diameter such as a metal tube 2 mm in diameter, closed at its end by a wall made from a relatively thin material, such as an aluminimum foil 0.01 mm in thickness, bored with a central orifice whose diameter varies between 0.15 and 0.25 mm.

4. The regenerator according to claim 1, characterized in that, at the end of the nozzle (2) is inserted a clockmaker's pivot bearing (13) made from ruby, saphire or cupro-beryllium, having a flat wall (14) orientated towards the outlet and being bored with a central orifice (15) whose diameter varies between 0.15 and 0.25 mm.

5. The regenerator according to claim 1, characterized in that, for an oxygen pressure varying from 1 to 2 bars, the mouthpiece of the nozzle is situated at a distance of 20 to 40 mm upstream of the constricted section of the venturi, whose diameter varies from 8 to 12 mm.

6. The regenerator according to claim 1, characterized in that, for a venturi whose outlet diameter is about 30 mm, the diameter of the constricted section is fixed at a value of 10 to 15 mm so as to obtain a voluminal yield of the order of 90.

* * * * *